United States Patent [19]

Dohse et al.

[11] Patent Number: 5,065,476

[45] Date of Patent: Nov. 19, 1991

[54] HANDLE ARRANGEMENT FOR A HANDHELD PORTABLE TOOL

[75] Inventors: Hans-Peter Dohse, Rommelshausen; Jochen Kramer, Stuttgart, both of Fed. Rep. of Germany

[73] Assignee: Andreas Stihl, Waiblingen, Fed. Rep. of Germany

[21] Appl. No.: 571,291

[22] Filed: Aug. 23, 1990

[30] Foreign Application Priority Data

Sep. 8, 1989 [DE] Fed. Rep. of Germany ..... 3929881
Jul. 4, 1990 [DE] Fed. Rep. of Germany ..... 4021277

[51] Int. Cl.[5] ..... B27B 17/02

[52] U.S. Cl. ..... 16/114 R; 16/110 R; 30/383

[58] Field of Search ..... 16/114 R, 110 R; 30/500, 519, 383, 381

[56] References Cited

U.S. PATENT DOCUMENTS 4,785,540 11/1988 Arvidsson .

FOREIGN PATENT DOCUMENTS 3114906 10/1982 Fed. Rep. of Germany ..... 30/383

*Primary Examiner*—Robert L. Spruill
*Assistant Examiner*—Carmine Cuda
*Attorney, Agent, or Firm*—Walter Ottesen

[57] ABSTRACT

The invention is directed to a rearward handle arrangement for a handheld portable tool defining a horizontal axis and having a motor housing and a forward handle fixedly attached to the housing so as to permit two-handed operation of the tool by an operator. The rearward handle arrangement includes: a carrier part for attaching the rearward handle arrangement to the housing of the tool; a rearward handle; and, a bearing journal for rotatably journalling the rearward handle in the carrier part so as to permit the rearward handle to rotate about the horizontal axis relative to the carrier part and the forward handle. The carrier part and the rearward handle conjointly define an interface and an unlatchable detent is disposed at this interface for self-latching the rearward handle on the carrier part at any one of a plurality of predetermined angular positions about the horizontal axis. These angular positions correspond to respective work positions in which the tool can be held by the operator.

16 Claims, 10 Drawing Sheets

XIV
XI
X
43
44
45
46
47
48
49
50
51
52
52'
53
54
55
57
58
59
60
41
42

HANDLE ARRANGEMENT FOR A HANDHELD PORTABLE TOOL

FIELD OF THE INVENTION

The invention relates to a handle arrangement for a handheld portable tool having two handles for enabling an operator to hold and manipulate the tool with both hands.

BACKGROUND OF THE INVENTION

U.S. Pat. No. 4,785,540 discloses a handheld portable tool having two handles for enabling an operator to guide the tool with both hands. The forward handle is journalled on the motor housing in such a manner that it is pivotable to the left and to the right about the longitudinal axis of the tool. The rearward handle is fixedly connected to the motor housing and contains a throttle lever for controlling the rotational speed of the drive motor. Because of the pivotability of the forward handle, this handle can be displaced into different working positions in correspondence to work requirements such as horizontal and vertical cuts as well as enabling the operator to work with the tool at hip height or above the head.

However, it is a disadvantage in this known arrangement that the position of the actuating lever and switch are also displaced when displacing the handle so that a sensitive actuation of the throttle lever or a rapid actuation of the stop switch cannot be assured in all operating positions. Furthermore, the known arrangement has no definite work positions; instead, the arrangement can be displaced continuously over the entire pivot range. This means that the frictional force of the bearing of the handle cannot be too great since otherwise a displacement into another work position would not be possible. On the other hand, this can cause an unwanted displacement which cannot be avoided such as a displacement accompanying a larger load or a sudden change in torque.

SUMMARY OF THE INVENTION

It is therefore an object of the invention to provide a handle arrangement for a handheld portable tool which simplifies manipulation by the operator and especially makes such manipulation safer.

The rearward handle arrangement of the invention is for a handheld portable tool having a motor housing and a forward handle fixedly attached to the housing so as to permit two-handed operation of the tool by an operator. The tool defines a horizontal axis and the rearward handle arrangement includes: a carrier part for attaching the rearward handle arrangement to the housing of the tool; a rearward handle; journalling means for rotatably journalling the rearward handle in the carrier part so as to permit the rearward handle to rotate about the axis relative to the carrier part and the forward handle; the carrier part and the rearward handle conjointly defining an interface; and, unlatchable detent means disposed at the interface for self-latching the rearward handle to the carrier part at any one of a plurality of predetermined angular positions about the axis and corresponding to respective work positions in which the tool can be held by the operator.

The essential advantages of the invention are seen in that the rearward handle can always be grasped by the hand independently of the work position thereby causing the throttle lever and switch to always be in the same position relative to the hand of the operator. In addition, an unwanted displacement out of the work position is prevented by the form-tight interengaging detent means which is self-latching. The invention is suitable for different handheld portable tools such as hedge trimmers, cutoff machines, brushcutters and motor-driven chain saws.

In a preferred embodiment of the invention, the unlatchable detent means includes a detent pawl journalled on the rearward handle and this detent pawl has a projection which engages in a corresponding recess of the carrier part. The detent pawl is resiliently biased by a spring in the direction of the latched position. The detent pawl must only be pivoted to unlatch the detent means since the detent pawl pivots back automatically and latches when reaching the next work position after a corresponding rotation of the handle in the carrier part. However, as an alternative, a detent pin can be provided which is longitudinally displaceable in a bore of the rearward handle and is pushed in a self-acting manner into a recess in the carrier part by means of a helical spring.

A safety device is provided to assure that a displacement from one work position into another work position does not occur while the portable tool is operating. With the safety device, the detent means can only be unlatched when the drive motor or portable tool is at standstill and the rearward handle is rotatable. It is also an advantage that the throttle lever is actuable only when the detent means is latched. For portable tools equipped with an internal combustion engine, it is not necessary to bring the engine to standstill; instead, it is only necessary to bring the working tool of the portable tool to standstill and this usually takes place in that the centrifugal clutch separates the working tool from the engine at idle speed.

The safety device by means of which a displacement from one work position into another work position is only possible when the work tool is at standstill can be configured in a simple manner in that the throttle lever includes a forward portion defining a path of movement which crosses over the pivot range of the detent pawl or the displacement path of a bracket arranged on the detent wedge.

The rearward handle is advantageously journalled with a substantially cylindrical extension in an annular portion of the carrier part. A radial projection is provided at the end of the extension which engages behind the annular portion. The cylindrical extension in this way forms a pivot bearing for the carrier part and the radial projection assures that the extension stays in the annular portion. The radial projection can, for example, be defined by a ring which is subsequently put in place or by means of projections appropriately formed at the end of the extension. To secure the carrier part on the extension of the rearward handle, the carrier part can include a transverse bore and an annular slot in the extension which are configured for accommodating a holding bolt. Only torsion acts on the throttle fuel line when displacing the handle because the throttle fuel line is guided coaxially through the extension and hooked into the throttle lever. Any change in direction of the course of the throttle fuel line is precluded.

The handle is preferably made of two handle shells with the partition plane extending asymmetrically in the direction of the handle at least in the region of the extension. In this way, a main segment and a complimentary segment are formed in the extension which conjointly define a jacket-like surface of the extension which is essentially cylindrical. In this way, it is possible that the radial projection can be configured as one piece with the extension. This projection extends only across a circular arc section and is arranged at the end of the main segment. The extension is axially held in the annular portion in this manner without it being necessary to provide additional components. This configuration in the form of a circular arc portion further affords the advantage that the ends of the circular arc segment coact with stop means arranged on the carrier part to provide a rotational angle limit with this stop means being annularly formed by an axial projection. The rotational angle limit assures that the handle is not rotated several times about the rotational axis which would otherwise act as a disadvantage for the throttle pull line.

An orthogonally arranged wall is provided in the main segment to provide form stiffness. This wall further provides a guide opening for the throttle pull line.

For most handheld portable tools it is completely adequate if the displacement is possible into three work positions. The detent means are therefore latchable in three work positions with the work positions being arranged one next to the other at an angle of 90°.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
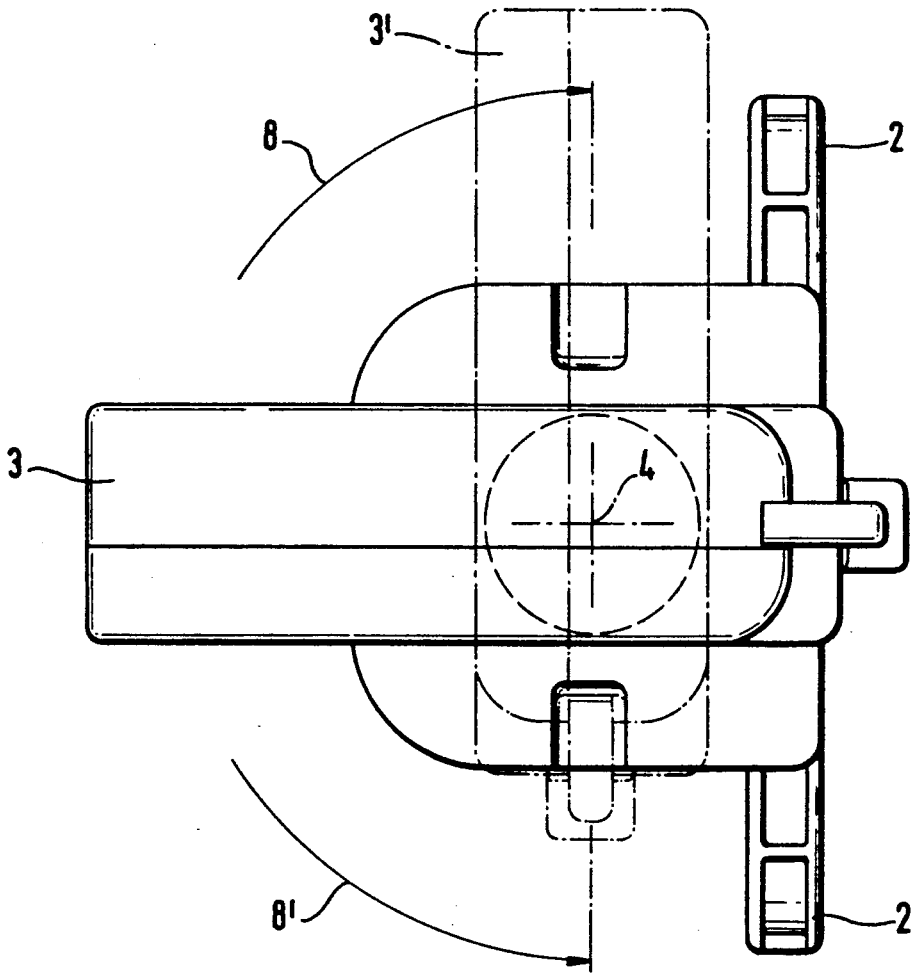
FIG. 1 is a schematic of a carrier part having a pivotable handle and showing the different work positions.

In FIG. 1, a carrier part 1 having carrier bearing journals 2 is shown for a handheld portable tool (not shown). A handle 3 is pivotally journalled on the carrier part 1 about a rotational axis 4. The handle 3 is disposed in a specific work position. The handle 3 can be pivoted into two additional work positions from the work position shown as indicated by the arrows 8 and 8'. Reference numeral 3' identifies the position which the handle assumes when pivoting in the direction of arrow 8. As shown in FIG. 1, the handle 3 can assume three different work positions so that the handheld portable tool can be manipulated in a suitable manner as required.

Figure 2:
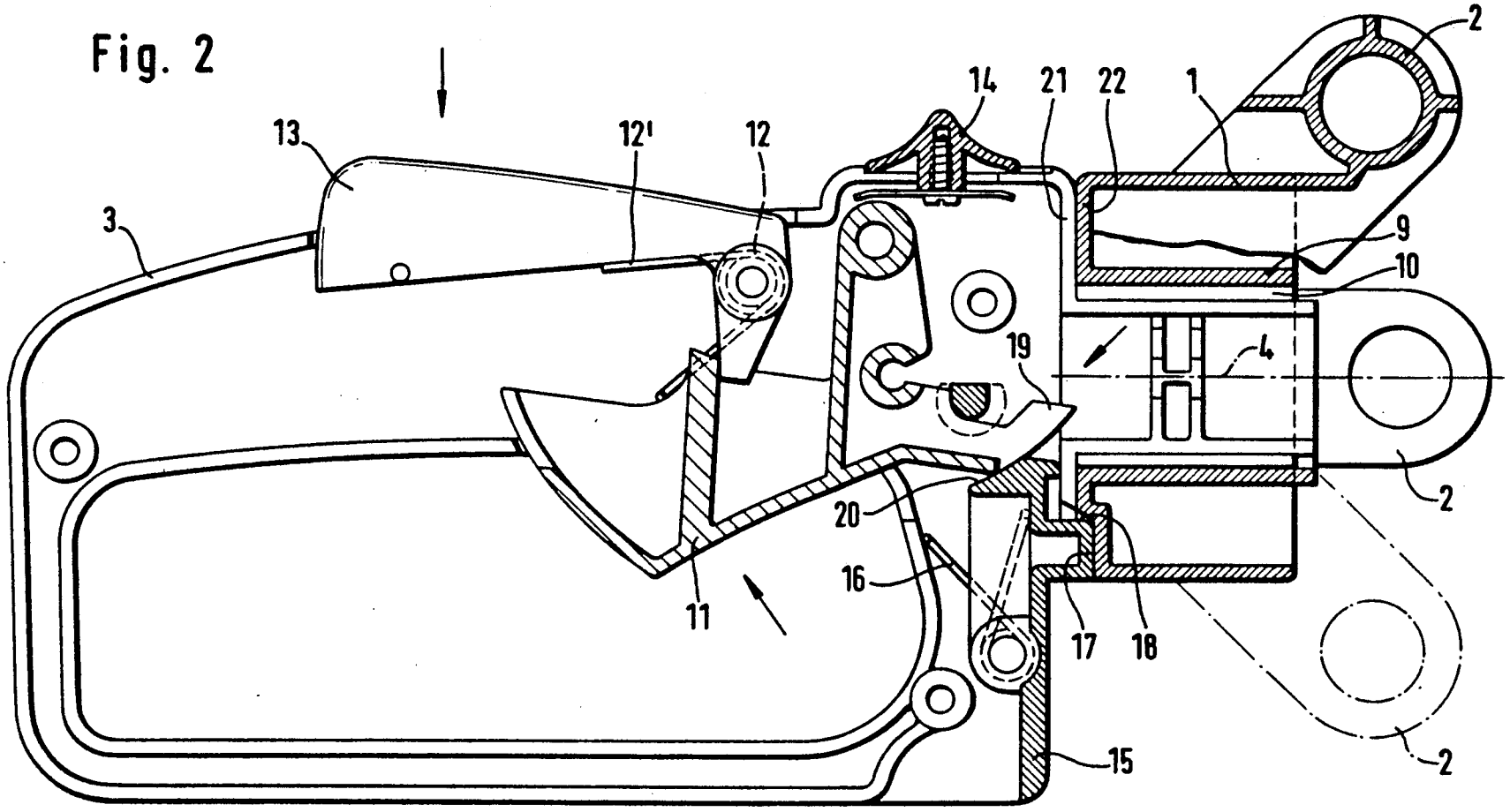
FIG. 2 is a longitudinal section view through the rearward handle and the carrier part.

FIG. 2 is a longitudinal section through the rearward handle 3 and the carrier part 1. Three bearing journals 2 are formed on the carrier part 1 and are provided for attachment to the motor housing of the handheld portable tool with vibration damping means connected therebetween. The carrier part 1 has an annular portion 9 wherein the extension 10 of the rearward handle 3 is disposed. The annular portion 9 and the extension 10 conjointly define a pivot bearing so that the handle 3 is pivotally journalled in the carrier part 1 about the rotational axis 4. A throttle lever 11 is mounted in the rearward handle 3 and is movable into its idle position by a leg spring 12. A leg 12' in the leg spring 12 braces against a throttle lever lock 13 which is thereby moved into its initial position wherein it projects outwardly out of the rearward handle 3.

A stop switch 14 is provided at the upper edge of the handle 3. A detent pawl 15 is pivotally journalled on the handle 3 on the side thereof facing toward the carrier part 1 with the detent pawl 15 being biased into a position by a leg spring 16 wherein a projection 17 formed on the detent pawl 15 engages in a corresponding recess in the carrier part 1. The throttle lever 11 has a portion 19 at its end facing toward the extension 10 and the path of movement of the portion 19 is guided along an upper limit surface 20 with the pivot movement of the throttle lever 11. In this way, a simultaneous actuation of the throttle lever 11 as well as the detent pawl 15 is prevented. The unlatching of the detent pawl is described later with respect to FIG. 4. The axial fixation of the handle 3 in the carrier part 1 takes place at the one side by a corresponding shoulder 21 on a radial section 22 of the carrier part 1 and also on the other side by a radial projection 31 which engages behind the annular portion 9 as shown in FIG. 5.

Figure 3:
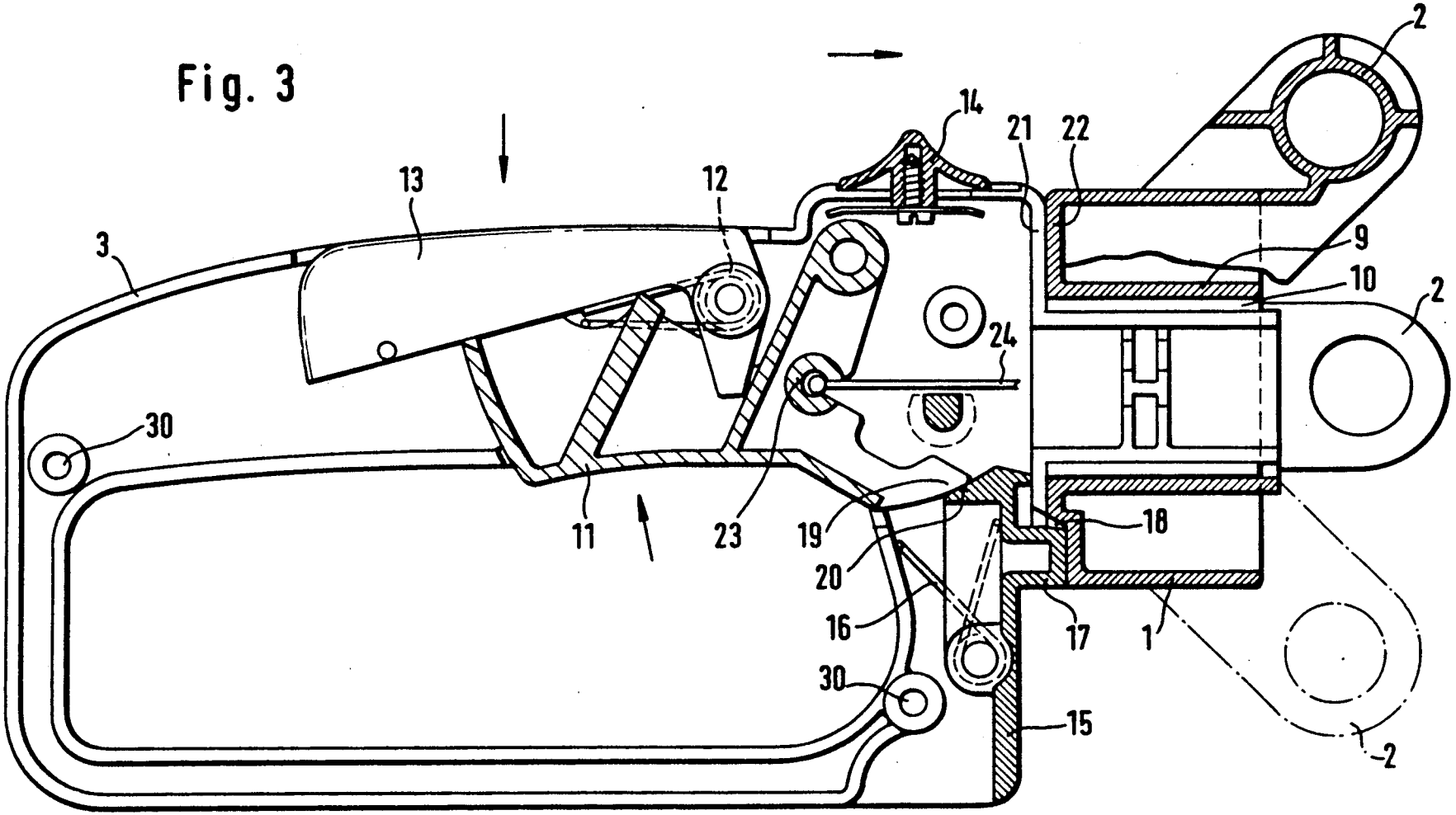
FIG. 3 corresponds to FIG. 2 with the throttle lever being fully depressed.

FIG. 3 likewise shows a longitudinal section through the rearward handle 3 and the carrier part 1 which corresponds essentially to FIG. 2 and therefore the reference numerals for FIG. 2 are taken for the corresponding parts.

FIG. 3 shows the throttle lever lock 13 and the throttle lever 11 in the depressed condition whereby the leg spring 12 is fully tensioned. A throttle actuating line 24 is hooked into a corresponding opening 23 in the throttle lever 11. In this position of the throttle lever 11, the portion 19 of the throttle lever is also disposed at the limiting surface 20 of the detent pawl 15 so that an actuation of the detent pawl in this position of the throttle lever 11 is precluded.

Figure 4:
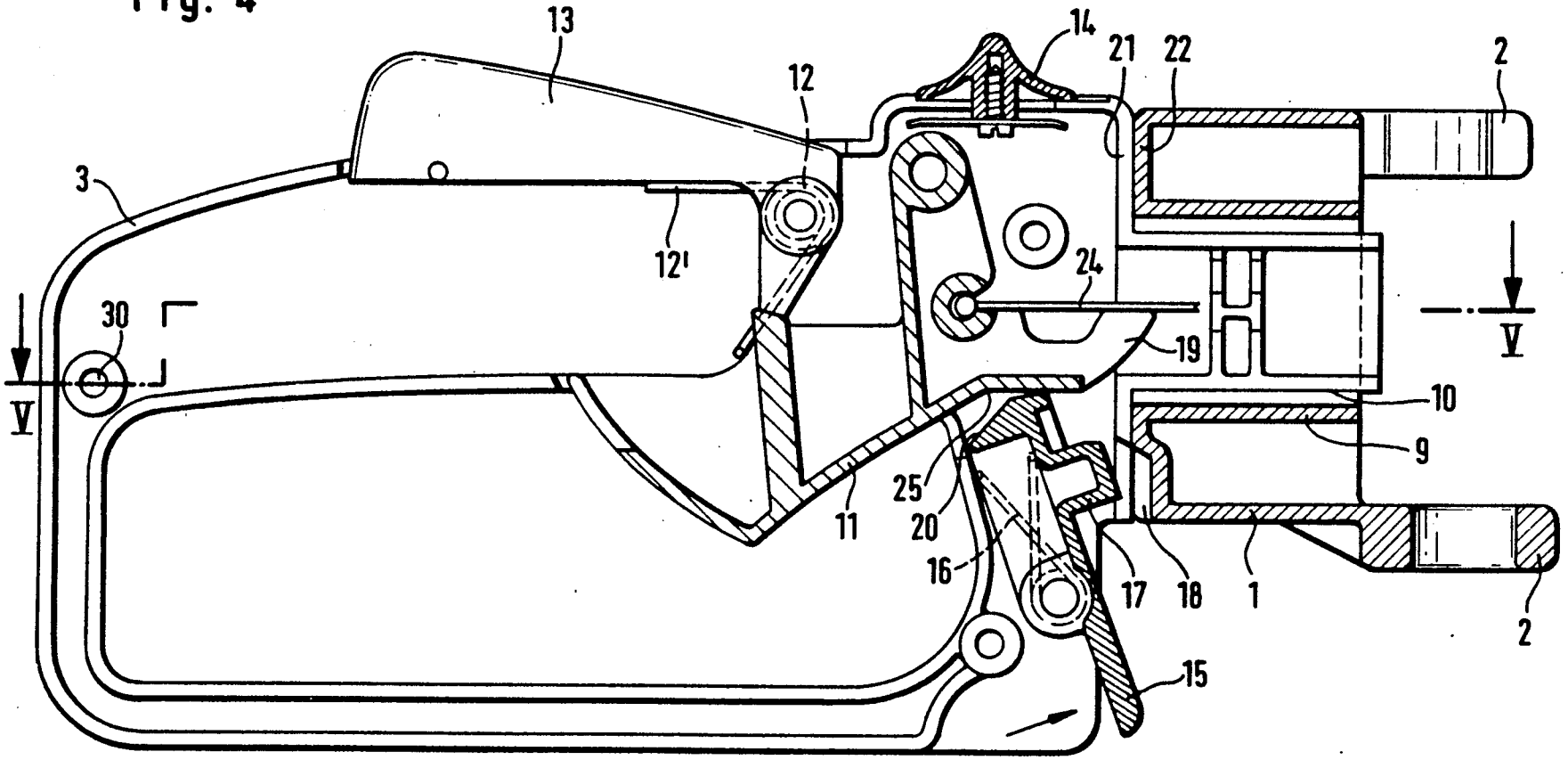
FIG. 4 is a section view corresponding to those shown in FIGS. 2 and 3 but with the detent pawl unlatched.
Figure 5:
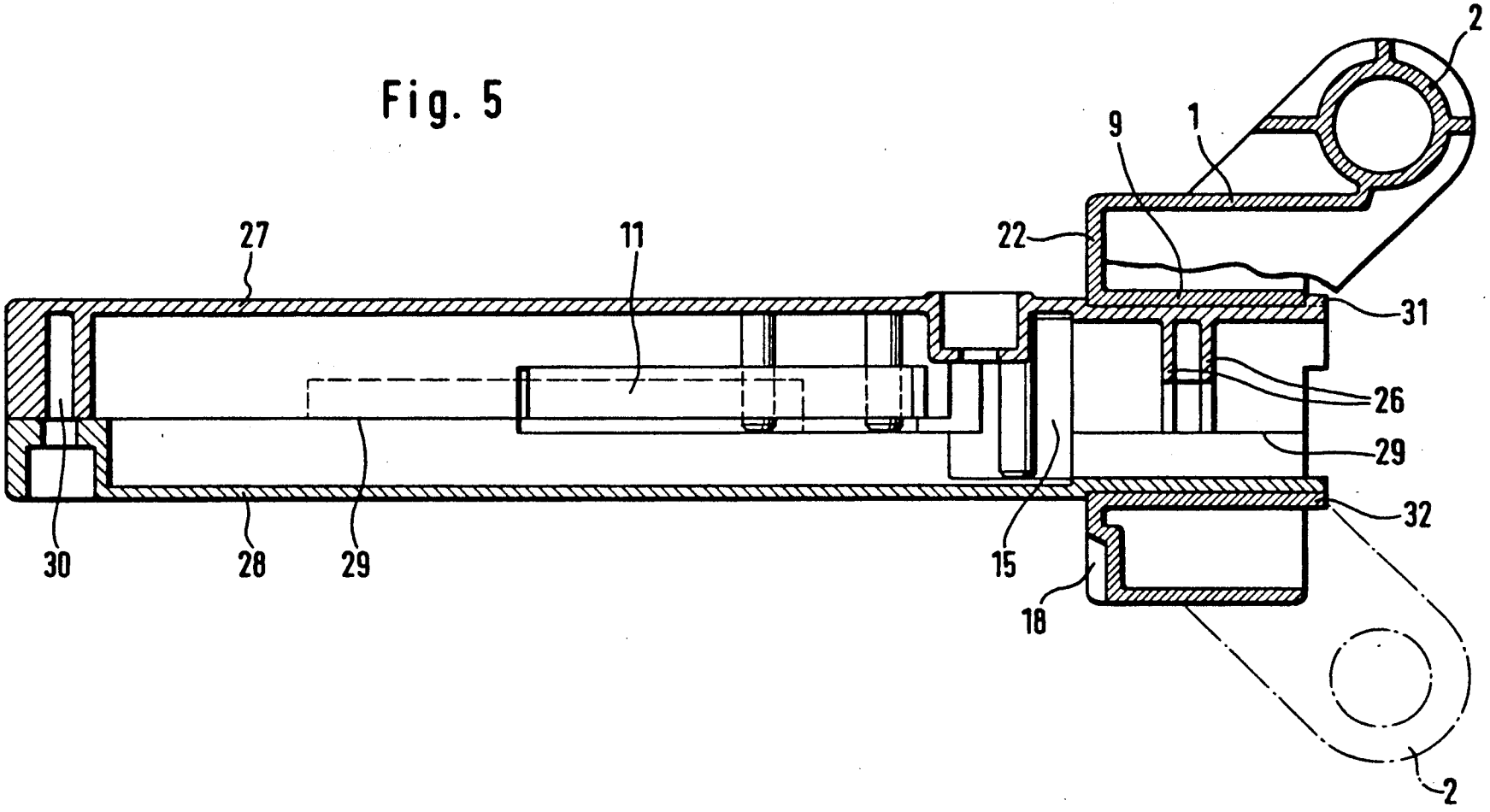
FIG. 5 is a section view taken along line V—V of FIG. 4.

FIG. 4 shows a longitudinal section through the rearward handle 3 with the throttle lever lock 13 as well as the throttle lever 11 disposed in their unactuated initial position. In this position of the throttle lever 11, the portion 19 is pivoted in the direction toward the throttle actuating line 24 to the extent that the arcuate portion 25 on the end of the throttle lever 11 facing the detent pawl 15 is disposed above the upper limit surface 20 of the detent pawl 15 and thereby clears the pivot path of the upper limit surface 20. In this way, the detent pawl 15 can be pivoted against the force of the spring 16 whereby the projection 17 is lifted out of the recess 18. With the detent pawl unlatched, the carrier part 1 can be rotated on the extension 10 about the axis 4 so that the carrier bearings 2 assume a position displaced by 90° with respect to FIG. 3. FIG. 4 clearly shows that in the unlatched position of the detent pawl 15, an actuation of the throttle lever 11 is precluded since the upper limit surface of the detent pawl 15 is disposed in the pivot region of the portion 19.

When the handle 3 is pivoted into a specific work position with respect to the carrier part 1 as shown for example in FIG. 4, then the detent pawl 15 is released which causes spring 16 to press the detent pawl into its rest position whereby the projection 17 engages in the recess 18 and forms a lock-tight connection. With respect to further details, FIG. 4 corresponds to the views already described in FIGS. 2 and 3 so that the same parts have the same reference numerals.

FIG. 5 shows a section view taken along line V—V in FIG. 4. This view shows that the handle 3 comprises a first handle shell 27 and a second handle shell 28 with the partition plane 29 extending asymmetrically through this plane in the longitudinal direction of the handle 3 as well as through the extension 10. The two handle shells 27 and 28 are held together with threaded fasteners for which corresponding bores 30 are provided. The throttle lever 11 and the detent pawl 15 are journalled between the first handle shell 27 and the second handle shell 28. Walls 26 which are directed orthogonally to the longitudinal axis are provided within the extension 10 of the first handle shell 27. On the one hand, these walls assure a stiffness of form of the bearing surfaces and, on the other hand, function to guide the throttle pull line.

FIG. 5 further shows that a radial projection 31 is formed at the outermost end of the extension 10. This projection 31 engages behind the annular portion 9 of the carrier part 1. It is also noticeable that the annular-shaped portion 9 has an axial projection 32 (see FIG. 8) on the lower part thereof. This projection 32 extends into the path of movement of the radial projection 31 (see FIG. 5) when rotating the handle 3 in the carrier part 1 and in this way, acts as a stop for limiting a maximum angular rotation.

Figure 6:
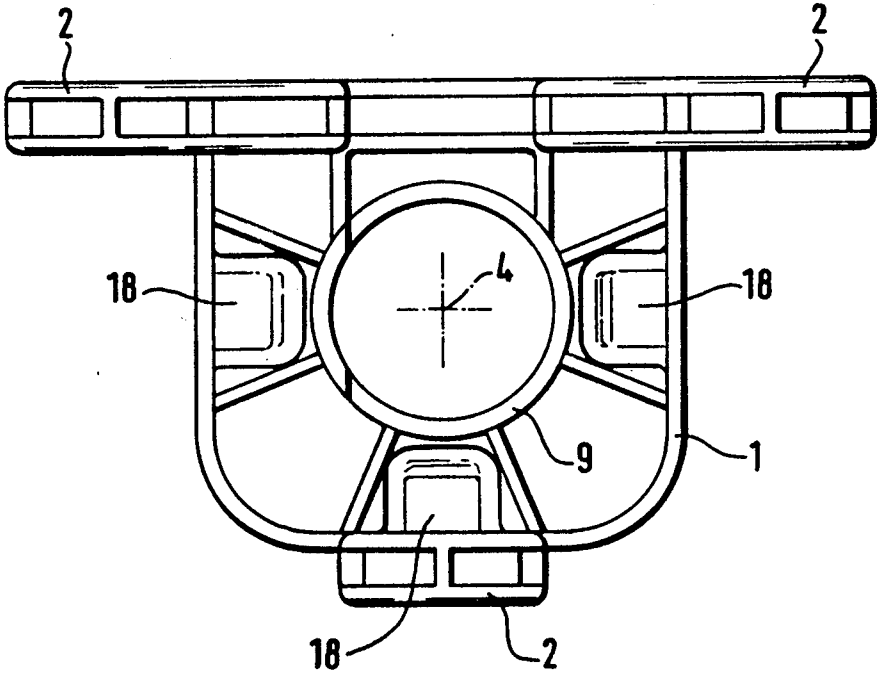
FIG. 6 shows the carrier part viewed in the direction of the rotational axis.

FIG. 6 shows the carrier part 1 and the arrangement of the carrier bearing journals 2. The rotational axis 4 is in the center of the annular-shaped portion 9 and three recesses 18 are arranged at an angle of 90° to each other referred to this axis. The arrangement of the three recesses 18 determines the three work positions which the handle 3 can assume with respect to the carrier part 1.

Figure 7:
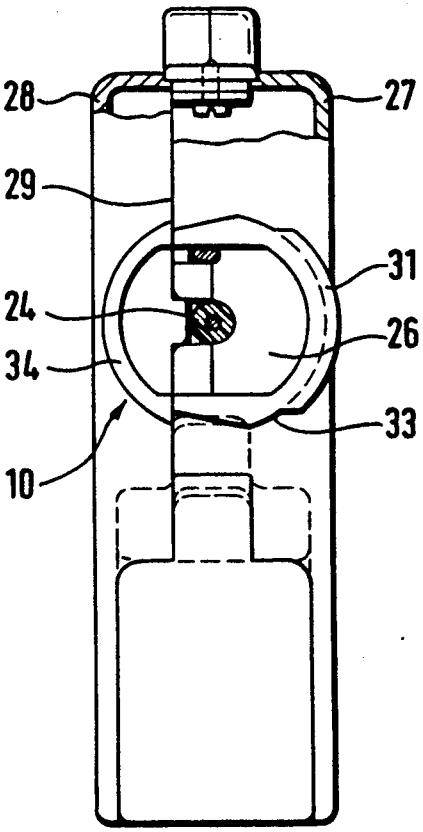
FIG. 7 shows the configuration of the bearing of the handle in the carrier part.

FIG. 7 shows the configuration of the extension 10 which is formed conjointly by the two handle shells 27 and 28. A main segment 33 is formed on the first handle shell 27 and has a cylindrical jacket-like surface over an angle of approximately 150° and has a tapering contour which faces toward the second handle shell 28 and the complimentary segment 34 formed thereon. The cylindrical jacket-like surface of the main segment 33 and the cylindrical jacket-like surface of the complimentary segment 34 thereby conjointly define the pivot bearing on which the carrier part 1 is journalled by means of its annular portion 9. The tapering contour on the main segment 33 is required for the assembly of the handle shells and therefore for the extension 10 in the carrier part 1. The radial projection 31 is shown on the main segment 33 and extends over a circular arc segment.

Figure 8:
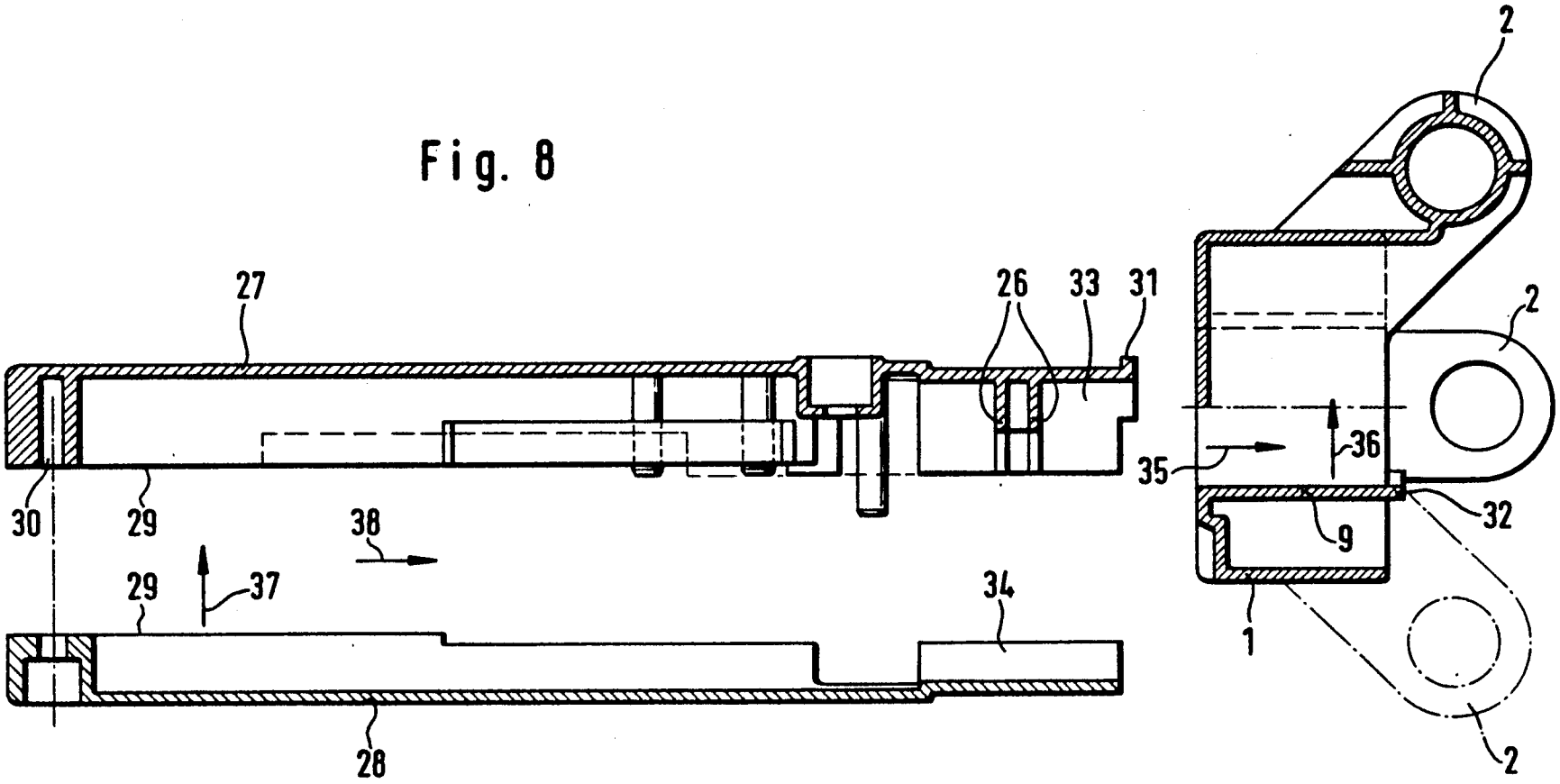
FIG. 8 shows the assembly process for attaching the handle in the carrier part.

The illustration of FIG. 8 is intended to make clear the assembly process of the handle 3 in the carrier part 1. The first handle shell 27 can be inserted in the direction of the arrow 35 through the annular-shaped portion 9 because of the configuration of the main segment 33 shown in FIG. 7. If the main segment 33 is disposed along its entire length within the annular-shaped portion 9, then a displacement occurs in the radial direction according to arrow 36 so that the radial projection 31 engages behind the annular portion 9. The second handle shell 28 is then placed against the first handle shell 27 which already contains the throttle lever, pawls and springs and this is indicated by the arrow 37. Thereafter, a longitudinal displacement in the direction of arrow 38 occurs whereby the complimentary segment 34 engages in the annular-shaped portion 9 and the extension 10 (FIG. 7) is thereby completed and this extension 10 defines the pivot bearing for the carrier part 1 as described earlier.

Figures 9, 10, 11:
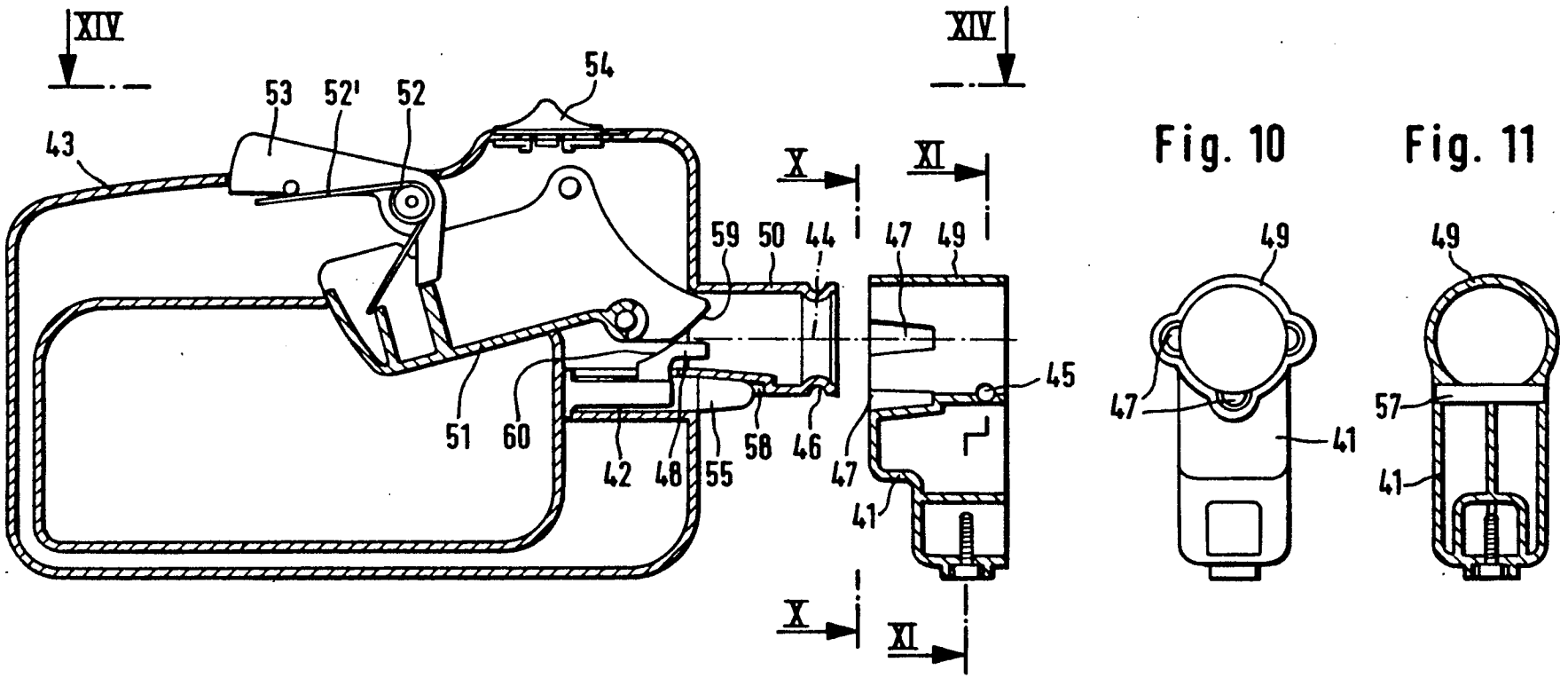
FIG. 9 is a longitudinal section view through another embodiment of the rearward handle and of the carrier part which is shown not mounted.
FIG. 10 is a view of the carrier part along line X—X of FIG. 9.
FIG. 11 is a section view taken along line XI--XI of FIG. 9.

FIG. 9 shows a longitudinal section through a rearward handle 43 and through a carrier part 41 which has not yet been mounted on handle 43. The carrier part 41 has an annular-shaped portion 49 which can be mounted on an extension 50 of the rearward handle 43. The annular-shaped portion 49 and the extension 50 define a pivot bearing so that the handle 43 is pivotally journalled about the rotational axis 44 on the carrier part 41.

In the mounted condition, a transverse bore 45 of the annular-shaped portion 49 is in alignment with an annular-shaped slot 46 of the extension 50. A holding bolt 57 (see FIG. 11) inserted into the transverse bore 45 holds the carrier part 41 on the extension 50. On one location of its periphery, the extension 50 has a recess 58 extending in the axial direction and this recess 58 has a slight conical shape into which a forward end of a detent wedge 55 having the same shape is disposed. The carrier part 41 has three recesses 47 on the annular-shaped portion 49 The three recesses are each displaced 90° from each other referred to the axis 44 and correspond to the mirror image of the recesses 58. The detent wedge 55 is longitudinally displaceably journalled in a corresponding bore 42 in the handle 43. The throttle lever 51, the throttle lever detent 53, the leg spring 52 and the leg 52' thereof and the stop switch 54 are identical to their counterparts in FIG. 2 with respect to configuration and function. The throttle lever 51 has a portion 59 which is guided along a limit surface 60 of a bracket 48 formed on the detent wedge 55. The function of these parts is the same as already described with respect to FIGS. 2 to 4.

FIG. 10 shows the three recesses 47 displaced one from the other by 90° at the edge of the annular-shaped portion 49 of the carrier part 41.

FIG. 11 shows a section view taken along line XI—XI of FIG. 9 with the holding bolt 57 seated in the transverse bore 45 of FIG. 9.

Figure 12:
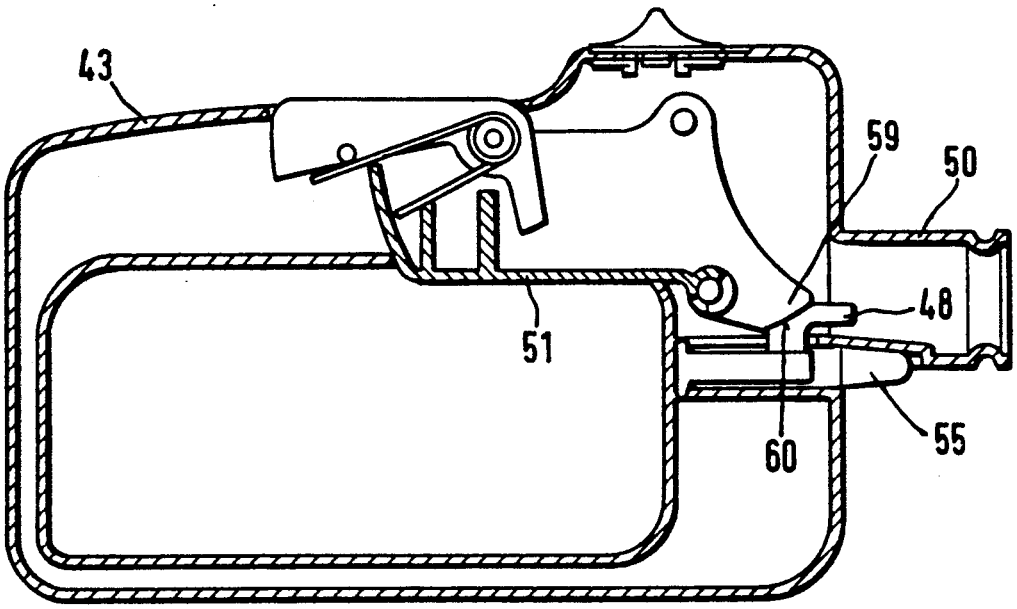
FIG. 12 is a section view taken through the rearward handle showing the throttle lever fully depressed.
Figure 13:
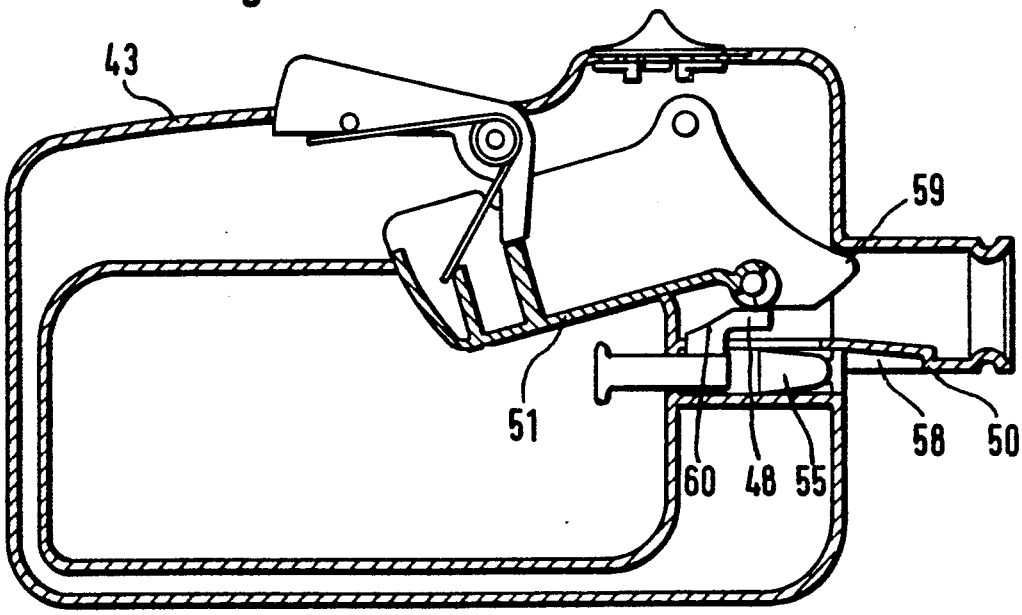
FIG. 13 is a section view taken through the rearward handle with the, detent wedge unlatched.

FIGS. 12 and 13 show the rearward handle 43 in the full throttle position (as in FIG. 3) and the idle position (as in FIG. 4), respectively. FIG. 12 shows that the portion 59 lies in a form-tight manner against the limit surface 60 of the bracket 48 and thereby prevents an unlatching of the detent wedge 55. In the idle position of FIG. 13, the portion 59 is disposed in the plane above the bracket 48 thereby providing the possibility of a linear displacement of the detent wedge 55 out of the recess 58.

Figure 14:
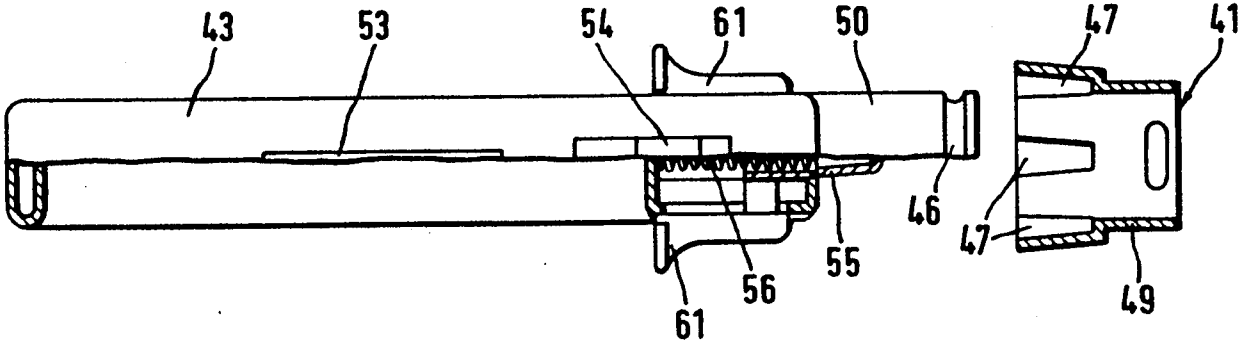
FIG. 14 is a view, partially in section, taken along line XIV—XIV of FIG. 9.

FIG. 14 is a view of the rearward handle 43 taken along the line XIV—XIV of FIG. 9. A portion of the rearward handle 43 is broken away in FIG. 14 and shows that the detent wedge 55 is biased by a helical spring 56 into the latched position. The detent wedge 55 has two arms 61 which project laterally from the rearward handle 43 and on which the operator can push the detent wedge 55 toward the rear and in FIG. 14 this is toward the left.

Figure 15A:
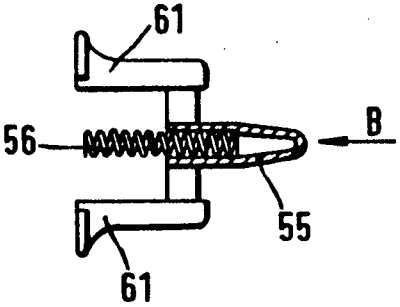
FIG. 15*a* is a plan view of the detent wedge.
Figure 15C:
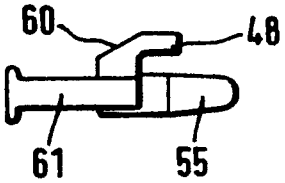
FIG. 15*c* is a side elevation view of the detent wedge.
Figure 15B:
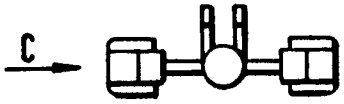
FIG. 15*b* a front elevation view of the detent wedge.

FIGS. 15*a* to 15*c* show different views of the detent wedge 55 with FIG. 15*b* showing the view in the direction of arrow B of FIG. 15*a* and 15*c* shows the detent wedge as seen in the direction of arrow C of FIG. 15*b*. The reference numerals in FIGS. 15*a* to 15*c* correspond to those appearing in FIGS. 9 to 14.

It is understood that the foregoing description is that of the preferred embodiments of the invention and that various changes and modifications may be made thereto without departing from the spirit and scope of the invention as defined in the appended claims.

What is claimed is:

1. A rearward handle arrangement for a handheld portable tool having a motor housing holding a motor and a forward handle fixedly attached to the housing so as to permit two-handed operation of the tool by an operator, the tool defining a horizontal axis and the rearward handle arrangement comprising:

a carrier part for attaching the rearward handle arrangement to the housing of the tool;

a rearward handle;

journalling means for rotatably journalling said rearward handle in said carrier part so as to permit said rearward handle to rotate about said axis relative to said carrier part and said forward handle;

said carrier part and said rearward handle conjointly defining an interface; and, unlatchable detent means disposed at said interface for self-latching said rearward handle to said carrier part at any one of a plurality of predetermined angular positions about said axis and corresponding to respective work positions in which the tool can be held by the operator.

2. The rearward handle arrangement of claim 1, said detent means including a detent pawl pivotally journalled in said rearward handle; a plurality of recesses formed in said carrier part defining respective ones of said work positions; said detent pawl having a projection formed thereon for engaging one of said recesses when said rearward handle is rotated about said axis into one of said work positions; and, resilient biasing means for resiliently biasing said detent pawl toward said recesses.

3. The rearward handle arrangement of claim 1, said detent means including passage means formed in said rearward handle and defining a passage axis; recess means formed in said carrier part; a detent wedge mounted in said passage means so as to be displaceable along said passage axis for engaging said recess means; and, resilient biasing means for resiliently biasing said detent wedge toward said recess means.

4. The rearward handle arrangement of claim 1, actuator means movably mounted in said rearward handle so as to be movable between first and second actuator positions corresponding to a standstill condition of the work tool and an operating condition of the work tool, respectively; and, said actuator means including safety hold means for blocking said detent means in the latched condition so long as said actuator means is out of said first actuator position and for permitting movement of said actuator means between said actuator positions so long as said detent means is in the latched condition.

5. The rearward handle arrangement of claim 4, said detent means including: a detent pawl pivotally journalled in said rearward handle; and, a plurality of recesses formed in said carrier part defining respective ones of said work positions; said detent pawl having a projection formed thereon for engaging one of said recesses when said rearward handle is rotated about said axis into one of said work positions; and, resilient biasing means for resiliently biasing said detent pawl toward said recesses; said actuator means being a throttle lever pivotally mounted on said rearward handle for pivoting through a pivot range between said first and second actuator positions; said throttle lever having a forward portion which traces a first path of movement as said throttle lever moves between said first and second actuator positions; said detent pawl being pivotally movable for tracing a second path of movement between a latched position wherein said projection is in one of said recesses and an unlatched position; and, said throttle lever and said detent pawl being mounted in said rearward handle so as to cause said first and second paths to cross over each other.

6. The rearward handle arrangement of claim 4, said detent means including passage means formed in said rearward handle and defining a passage axis; recess means formed in said carrier part; a detent wedge mounted in said passage means so as to be displaceable along said passage axis for engaging said recess means; and, resilient biasing means for resiliently biasing said detent wedge toward said recess means; said actuator means being a throttle lever pivotally mounted on said rearward handle for pivoting through a pivot range between said first and second actuator positions; said throttle lever having a forward portion which traces a first path of movement as said throttle lever moves between said first and second actuator positions; said detent wedge having a bracket formed thereon and being slideably movable between a latched position wherein said detent wedge is in one of said recesses and an unlatched position so as to cause said bracket to trace a second path of movement; and, said throttle lever and said detent wedge being mounted in said rearward handle so as to cause said first and second paths to cross over each other.

7. The rearward handle arrangement of claim 1, said journalling means including an annular portion formed on said carrier part; and, a substantially cylindrical extension formed on said rearward handle and being rotatably journalled in said annular portion.

8. The rearward handle arrangement of claim 7, said extension having a radial projection formed thereon for engaging behind said annular portion when said extension is inserted into said annular portion.

9. The rearward handle arrangement of claim 7, said annular portion having a transverse bore formed therein and said extension having an annular slot formed therein; and, said handle arrangement further comprising a holding pin for engaging said slot and said bore for holding said rearward handle on said carrier part.

10. The rearward handle arrangement of claim 7, said handle having a throttle lever pivotally mounted thereon and said motor being a gasoline engine having a throttle pull wire and said extension having guide means formed thereon for guiding said wire therethrough.

11. The rearward handle arrangement of claim 7, said rearward handle including two handle shells conjointly defining a partition interface extending in the direction of said axis and asymmetrically through said cylindrical extension so as to cause said cylindrical extension to have a main segment and a complementary segment.

12. The rearward handle arrangement of claim 11, said main segment having an outer end; and, said cylindrical extension having a radial projection formed on said end of said main segment; said radial projection being formed on said end so as to extend arcuately for engaging behind said annular portion when said extension is inserted into said annular portion.

13. The rearward handle arrangement of claim 12, said carrier part having an arcuate segment formed thereon to define a stop face for receiving said radial projection thereagainst when said main segment is rotated in said annular portion thereby limiting the angle through which said main segment can be rotated in said annular portion.

14. The rearward handle arrangement of claim 11, said handle having a throttle lever pivotally mounted thereon and the motor being a gasoline engine having a throttle pull wire connected to the throttle lever; said main segment having a wall formed therein at right angles to said axis for defining a guide for the throttle pull wire.

15. The rearward handle arrangement of claim 1, said angular positions being spaced at 90° from each other.

16. The rearward handle arrangement of claim 1, said rearward handle having a top wall and said handle arrangement further comprising a stop switch mounted in said wall so as to be centered on said handle.

* * * * *